US006519995B2

(12) United States Patent
Matsuoka

(10) Patent No.: US 6,519,995 B2
(45) Date of Patent: Feb. 18, 2003

(54) ROTARY CAM DRIVING APPARATUS FOR NEGATIVE-ANGLE FORMING DIE

(75) Inventor: Mitsuo Matsuoka, Hirakata (JP)

(73) Assignee: Umix Co., Ltd., Osaka (JP)

( * ) Notice: Subject to any disclaimer, the term of this patent is extended or adjusted under 35 U.S.C. 154(b) by 0 days.

(21) Appl. No.: 09/875,089

(22) Filed: Jun. 7, 2001

(65) Prior Publication Data

US 2002/0121123 A1 Sep. 5, 2002

(30) Foreign Application Priority Data

Mar. 5, 2001 (JP) ..... 2001-060174

(51) Int. Cl.[7] ..... B21D 5/04
(52) U.S. Cl. ..... 72/312; 72/387; 72/452.9
(58) Field of Search ..... 72/312–315, 452.9, 72/388, 387, 319; 74/89

(56) References Cited

U.S. PATENT DOCUMENTS

| | | | | | |
|---|---|---|---|---|---|
| 2,272,740 | A | * | 2/1942 | Fader, Jr. | 72/312 |
| 5,746,082 | A | | 5/1998 | Matsuoka | 72/313 |
| 5,784,916 | A | * | 7/1998 | Matsuoka | 72/313 |
| 6,038,908 | A | * | 3/2000 | Kinoshita | 72/313 |
| 6,196,040 | B1 | * | 3/2001 | Matsuoka | 72/315 |

FOREIGN PATENT DOCUMENTS

| | | | | |
|---|---|---|---|---|
| JP | 5-261441 | * | 10/1993 | 72/315 |

* cited by examiner

*Primary Examiner*—Daniel C. Crane
(74) *Attorney, Agent, or Firm*—Birch, Stewart, Kolasch & Birch, LLP

(57) ABSTRACT

Disclosed is a negative-angle forming die. The die has upper and lower halves. The upper die half has a supporting portion for receiving a sheet metal work, and an intrusion forming portion. The lower die half carries a plate-like cam which can be moved toward the lower die half for forming the work. The die also has a rotary cam, the ends of which terminate in first and second shafts journaled in the lower die half. The die also has a slide cam, which itself has an intrusion forming portion. This portion is slidably opposed to the rotary cam. The die is equipped with a cam follower arm centrally fastened to the supporting shaft. One end of the cam follower arm carries a cam follower in operable relationship with the plate-like cam carried by the upper die half. In operation moving contact between the plate-like cam and the cam follower causes the cam follower arm to rotate. This in turn causes rotation of the rotary cam. When the work is placed on the supporting portion of the lower die half, it is formed by the intrusion forming portion of the rotary cam and the intrusion forming portion of the slide cam.

3 Claims, 8 Drawing Sheets

ROTARY CAM DRIVING APPARATUS FOR NEGATIVE-ANGLE FORMING DIE

BACKGROUND OF THE INVENTION

The present invention relates to a rotary cam driving apparatus in a negative-angle forming die for forming sheet metal. Herein, the negative-angle forming die is used for a formation made at a location more inward of a lower die half than a straight downward stroke line of an upper die half.

The negatively angled forming of a sheet metal into a shape having a portion more inward of the lower die half than the straight downward stroke line of the upper die half is generally performed by using a slide cam.

According to a prior-art intrusion forming process of the sheet metal work, the work is placed on the lower die half and the upper die half is lowered vertically. At this time a drive cam of the upper die half drives a driven cam of the lower die half, forming the work from the side. After the formation Is completed and the upper die half is lifted, then the driving cam is retracted by a spring. In the above arrangement, the driven cam slid onto the work from the side has a forming portion which is formed as a single piece in the same shape as the work as after the formation. The lower die half however, must allow the work to be taken out from the lower die half after the formation, and for this reason, a portion of the lower die half providing the intrusion formation must be made separable for retraction, or a rear portion thereof must be cut off so that the work can be moved forward and taken out. This does not pose a serious problem if the extent of the intrusion is small. However, the problem becomes serious if the extent of the intrusion is large, or if the work is to be formed into a long frame having a groove-like section such as in a formation of an automobile front pillar-outer from sheet metal. Specifically, since the groove width of the work is so narrow, that if the portion of the lower die half corresponding to the groove is divided or cut off, it becomes impossible for the forming portion of the driven cam to form clearly. In addition, strength of the lower die decreases. Thus, it was impossible to perform a clear-shaped intrusion formation.

Further, a formed product sometimes has a twist or distortion, which must be corrected. However, for example, many automobile parts that provide the outer skin of the automobile, such as a side panel, fender, roof, bonnet, trunk lid, door panel, front pillar-outer and so on, are formed to have a three-dimensional surface or line, and therefore it is practically impossible to make correction after the formation. In assembling the automobile sheet-metal parts, if there is a twist or distortion in the parts, it is difficult to fit the parts together.

Without solving this problem, it was impossible to provide a high quality automobile sheet metal structure, and it was impossible to maintain a required level of product accuracy in the formed sheet metal products. In order to solve the above-described problem, an arrangement was proposed, in which the straight downward stroke of the upper die half is converted to a rotary movement of a rotary cam to pivot to form the portion in the lower die half more inward than the straight downward stroke line of the upper die half. In this arrangement, after the forming operation, the rotary cam is pivoted back to a state where the completed work can be taken out of the lower die. This arrangement will be described in more detail.

Specifically, as shown in FIG. 5 to FIG. 8, this negative-angle forming die comprises a lower die half 102 including a supporting portion 101 on which a work W is placed and an upper die half 103 which is lowered straightly down onto the lower die half 102 to press and thereby form the work W. The lower die half 102 is rotatably provided with a rotary cam 106 supported in an upwardly opening axial groove 104. The groove 104 has a portion close to the supporting portion 101 formed with an intrusion forming portion 105 located more inward than a stroke line of the upper die half 103. The lower die half 102 rotatably supports a rotary cam 106. The upper die half 103 is provided with a slide cam 108 opposed to the rotary cam 106 and provided with an intrusion forming portion 107. The lower die half is further provided with an automatic retractor 109 which moves the rotary cam 106 back to the sate that allows the work W to be taken out of the lower die half 102 after the formation. The work W placed on the supporting portion 101 of the lower die half 102 is formed by the intrusion forming portion 105 of the rotary cam 106 and the intrusion forming portion 107 of the slide cam 108. The work W is formed by a rotary movement of the rotary cam 106 and a sliding movement of the slide cam 108. After the formation, the automatic retractor 109 pivots back the rotary cam 106, allowing the work W to be taken out of the lower die half 102.

SUMMARY OF THE INVENTION

Now, an operation of this negative-angle forming die will be described.

First, as shown in FIG. 5, the upper die half 103 is positioned at its upper dead center. At this stage, the work W is placed on the supporting portion 101 of the lower die half 102. The rotary cam 106 is held at its retracted position by the automatic retractor 109.

Next, the upper die half 103 begins to lower, and first, as shown in FIG. 6, a lower surface of the slide cam 108 makes contact with a pivoting plate 111 without causing the slide cam 108 to interfere with the intrusion forming portion 105 of the rotary cam 106, pivoting the rotary cam 106 clockwise as in FIG. 10, thereby placing the rotary cam 106 at a forming position. Then, a pad 110 presses the work W.

When the upper die half 103 continues to lower, the slide cam 108, which is under an urge outward of the die half, begins a sliding movement as the sliding cam in a laterally leftward direction, against the urge from a coil spring 112. This is the state shown in FIG. 7, where the intrusion forming portion 105 of the pivoted rotary cam 106 and the intrusion forming portion 107 of the slide cam 108 form the work W.

After the intrusion formation, the upper die half 103 begins to rise. The slide cam 108, which is urged outwardly of the die half by the coil spring 112, moves in a laterally rightward direction as in FIG. 8, and keeps rising without interfering with the work W as after the intrusion formation.

On the other hand, the rotary cam 106 is released from the holding by the slide cam 108, and therefore is pivoted in a leftward direction as in FIG. 8 by the automatic retractor 109. Thus, when the work W is taken out of the lower die half after the intrusion formation, the work W can be removed without interference with the intrusion forming portion 105 of the rotary cam 106.

The automatic retractor is essential for pivoting back the rotary cam after the intrusion formation, in order to take the formed work out of the lower die half as described above.

According to the above prior art, the automatic retractor is provided by a pin and coil spring. Generally, however, an air cylinder is often used.

If the air cylinder is used, the air cylinder must be timed to a specific period in the downward stroke of the pressing apparatus. Further, if the air cylinder is used, the air cylinder must be connected with piping of a specific diameter matched with the air cylinder. Although such a specific piping is prepared timely at an occasion of mass-production pressing operation, the piping of the matched size is often not available at a time of tryout production for example, in a preparation step for a full-scale production.

Now, in consideration of the background described above, the present invention aims to eliminate the need for the timing adjustment of the air cylinder operation at the time of pressing operation and to simplify the piping necessary for the air cylinder. In order to achieve the above objects, the present invention provides a rotary cam driving apparatus for a negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion inward of a downward stroke line of the upper die half, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, a center portion of a cam follower arm being fastened to the supporting shaft, an end of the cam follower arm being connected to a piston rod of a cylinder provided in the lower die half, another end of the cam follower arm being contacted with a driver provided in the upper die half.

DETAILED DESCRIPTION OF THE PREFERRED EMBODIMENT

Figure 1:
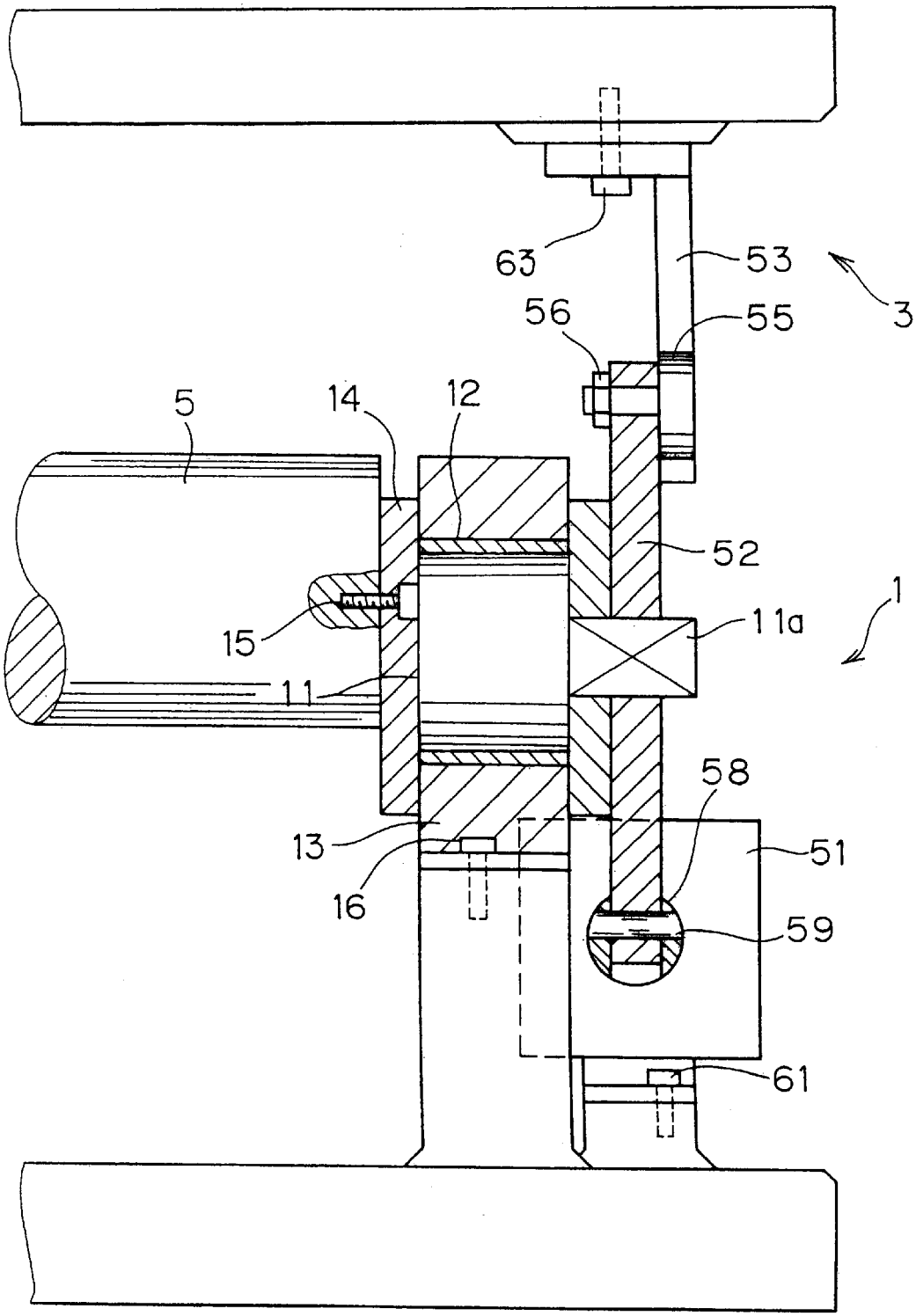
FIG. 1 is a conceptual diagram of a rotary cam driving apparatus for a negative-angle forming die, according to the present invention.

The present invention will now be described in detail, with reference to FIG. 1, FIG. 2, FIG. 3 and FIG. 4 of the attached drawings.

A lower die half 1 rotatably supports a rotary cam 5. The lower die half 1 is provided with a cylinder 51 that automatically retracts the rotary cam 5. The rotary cam 5 is provided with a cam follower arm 52. An upper die half 3 is provided with a plate-like cam 53 for controlling the cam follower arm 52.

The shaft-like rotary cam 5 has two ends each provided with a supporting shaft 11 extending therefrom. Each of the supporting shafts 11 is fitted into a tubular metal sleeve 12 fixed in a bearing 13, making the rotary cam 5 rotatable. The supporting shaft 11 has a base plate 14 fixed by a bolt 15 to an end of the shaft 11 of the rotary cam 5. The bearing 13 to which the supporting shaft 11 is fitted is fixed to the lower die half 1 by a bolt 16.

The supporting shaft 11 has an end portion 11*a* formed as a quadrangular prism so that an output from the air cylinder 51 can be transferred reliably to the rotary cam 5.

The cam follower arm 52 includes a disc portion, and is made of two members, one of which has two portions extending away from each other out of the disc portion. The two members sandwich the end portion 11*a* of the supporting shaft 11 at a center of the disc portion and are held by bolts 54. A cam follower 55 is rotatably provided at an end of the cam follower arm 52, with a nut 56 threaded to prevent removal. Another end of the cam follower 52 is connected to an end of a piston rod 57 of the cylinder 51 by a pin 59 via a connecting member 58. The cylinder 51 is attached to the lower die half 1 by a bolt 61 via a bracket 60.

The plate-like cam 53 is provided in the upper die half 3 at a place opposed by the cam follower arm 52. The cam 53 has a cam surface 62 contacted by the cam follower 55 of the cam follower arm 52, thereby controlling the pivoting movement of the rotary cam 5. The cam surface 62 is designed by taking into consideration at which point during the downward stroke of the pressing apparatus, the cam 5 should begin pivoting, and at which point of the pivoting movement the rotary cam should be held in a predetermined forming attitude. The cam surface 62 has a slanted portion 62*a* for pivoting the rotary cam 5. The cam surface 62 also has a vertical portion 62*b* for maintaining the forming attitude.

The plate-like cam 53 is fixed to the upper die half 3 by a bolt 63.

The cylinder 51 automatically retracts the rotary cam 5 when the upper die half 3 has risen to a point where the cam follower 55 of the cam follower arm 52 no longer contacts the cam surface 62 of the driver 53.

Figure 2:
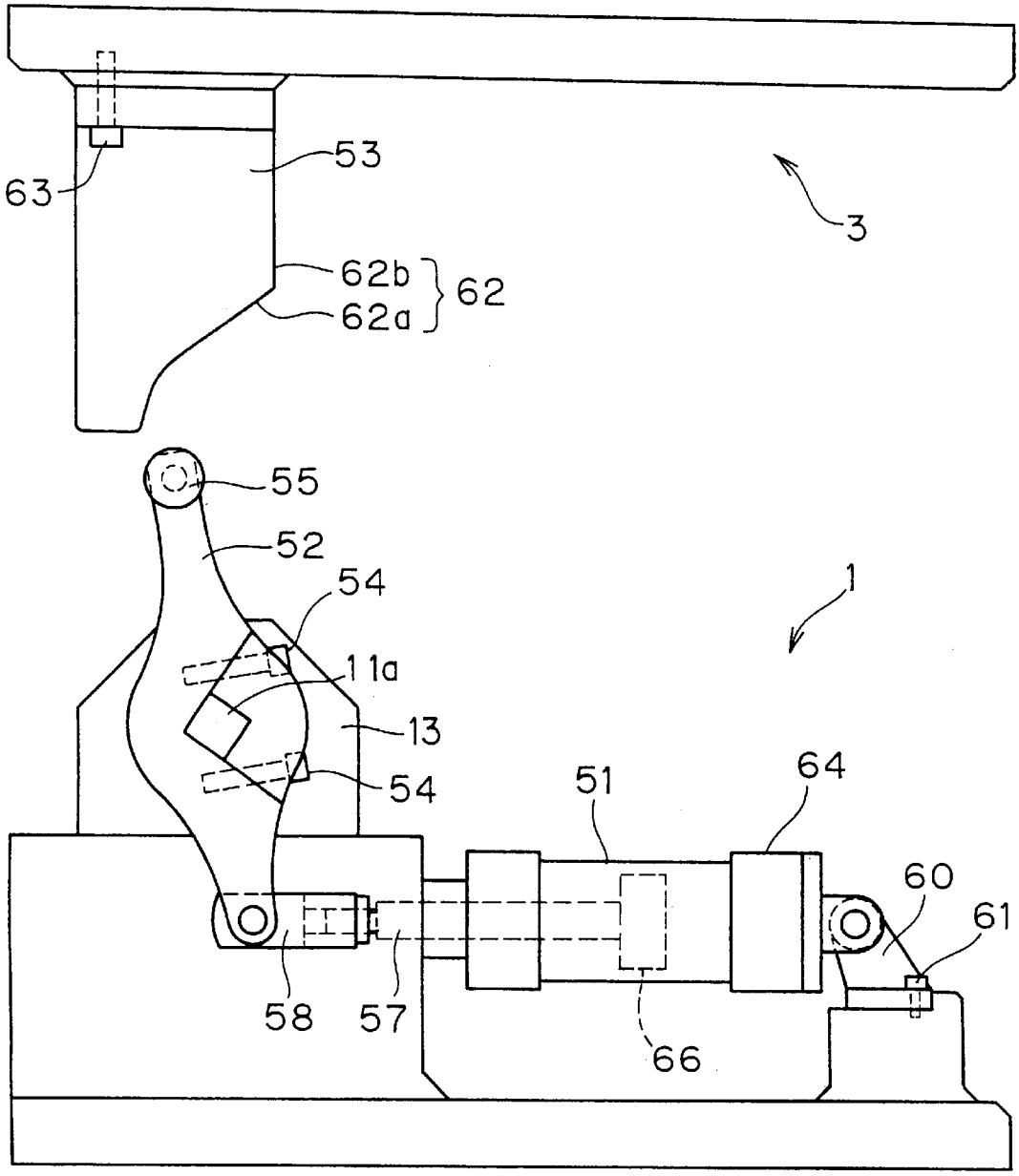
FIG. 2 is a side view of an embodiment of the rotary cam driving apparatus for a negative-angle forming die, according to the present invention, with an upper die half being at an upper dead center.
Figure 3:
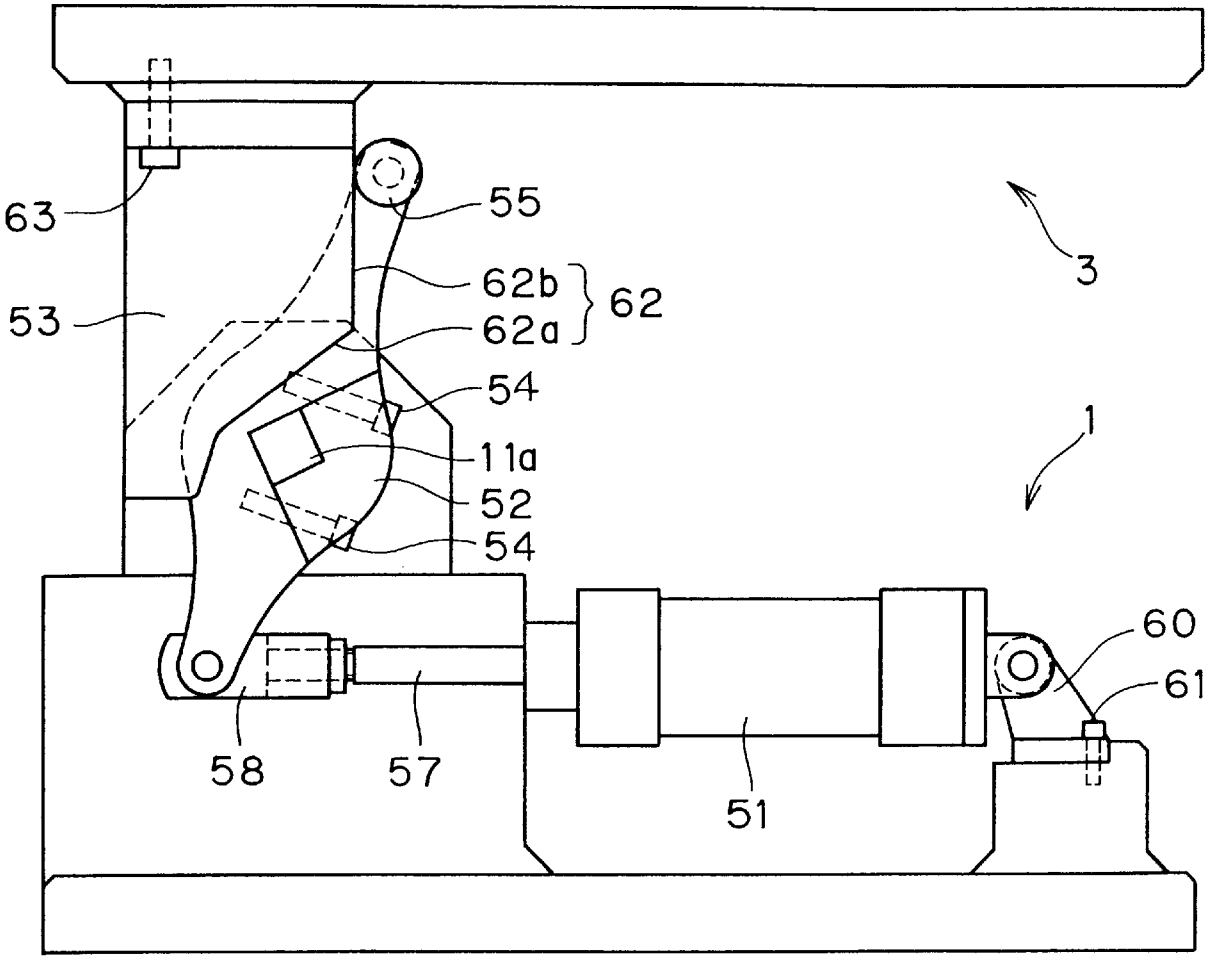
FIG. 3 is a side view of the apparatus in FIG. 2, with the upper die half being at a lower dead center.
Figure 4:
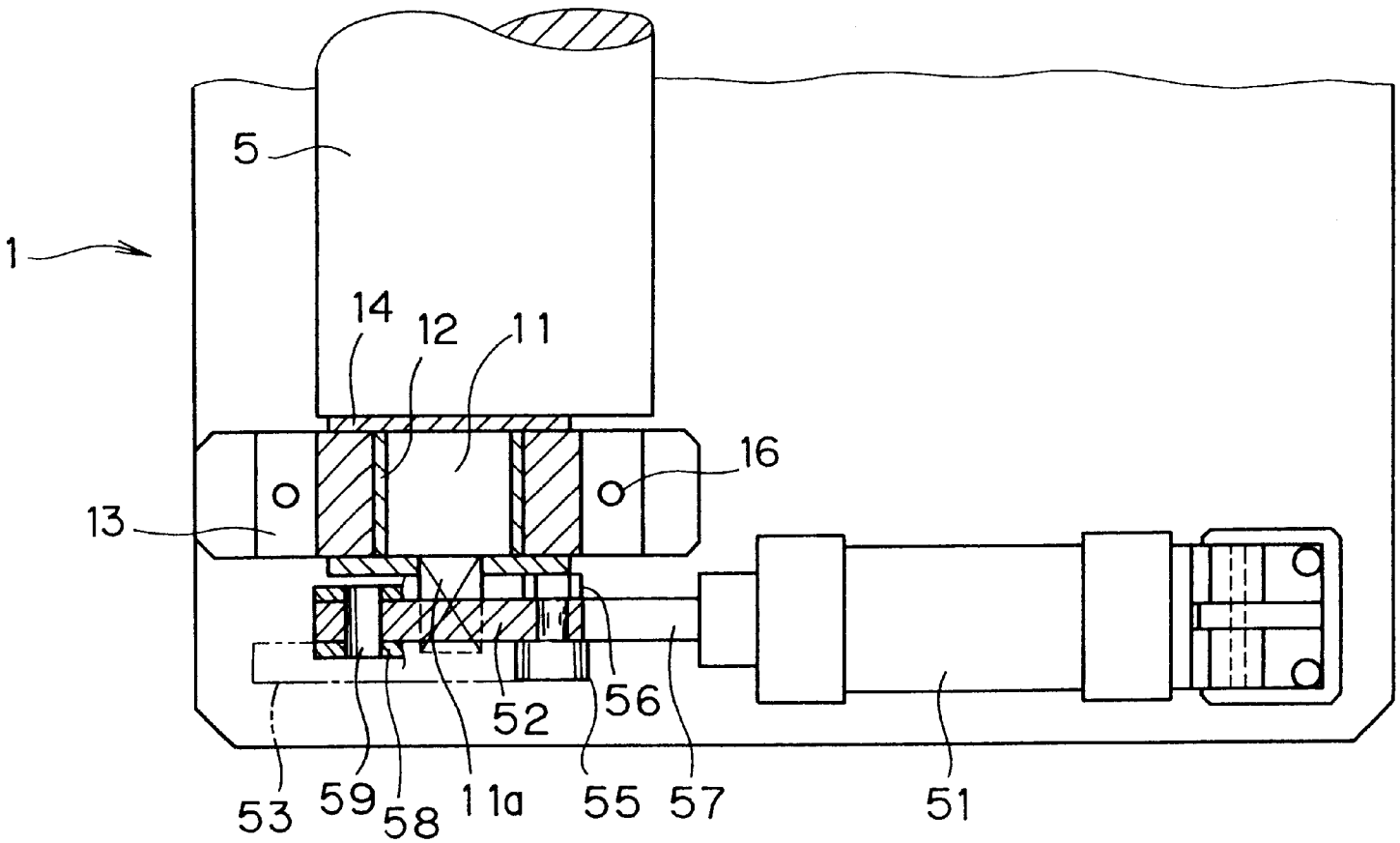
FIG. 4 is a plan view of the apparatus in FIG. 3.
Figure 5:
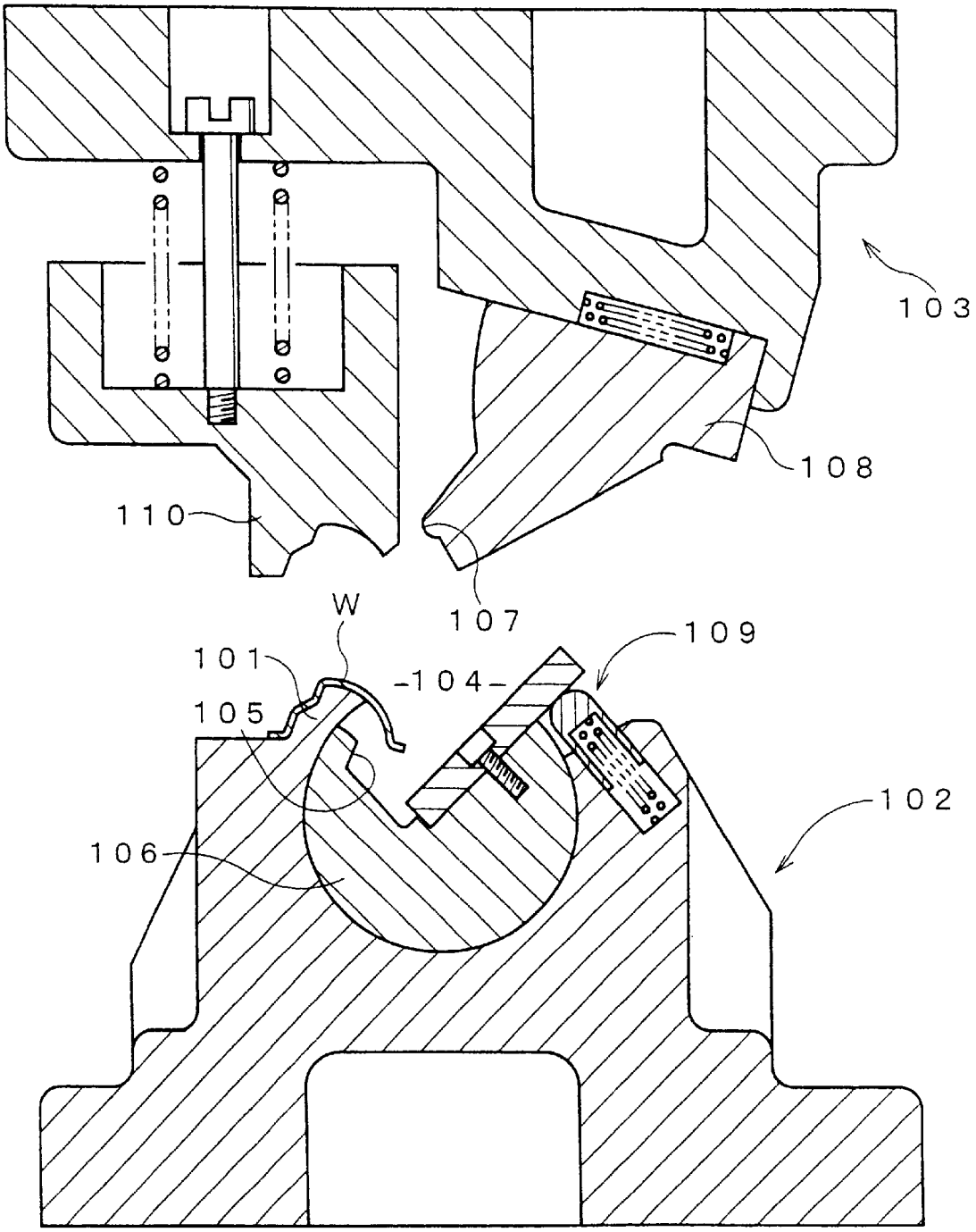
FIG. 5 BACKGROUND ART
FIG. 5 is a sectional side view of a prior art negative-angle forming die for intrusion formation, with an upper die half thereof being at its upper dead center.
Figure 6:
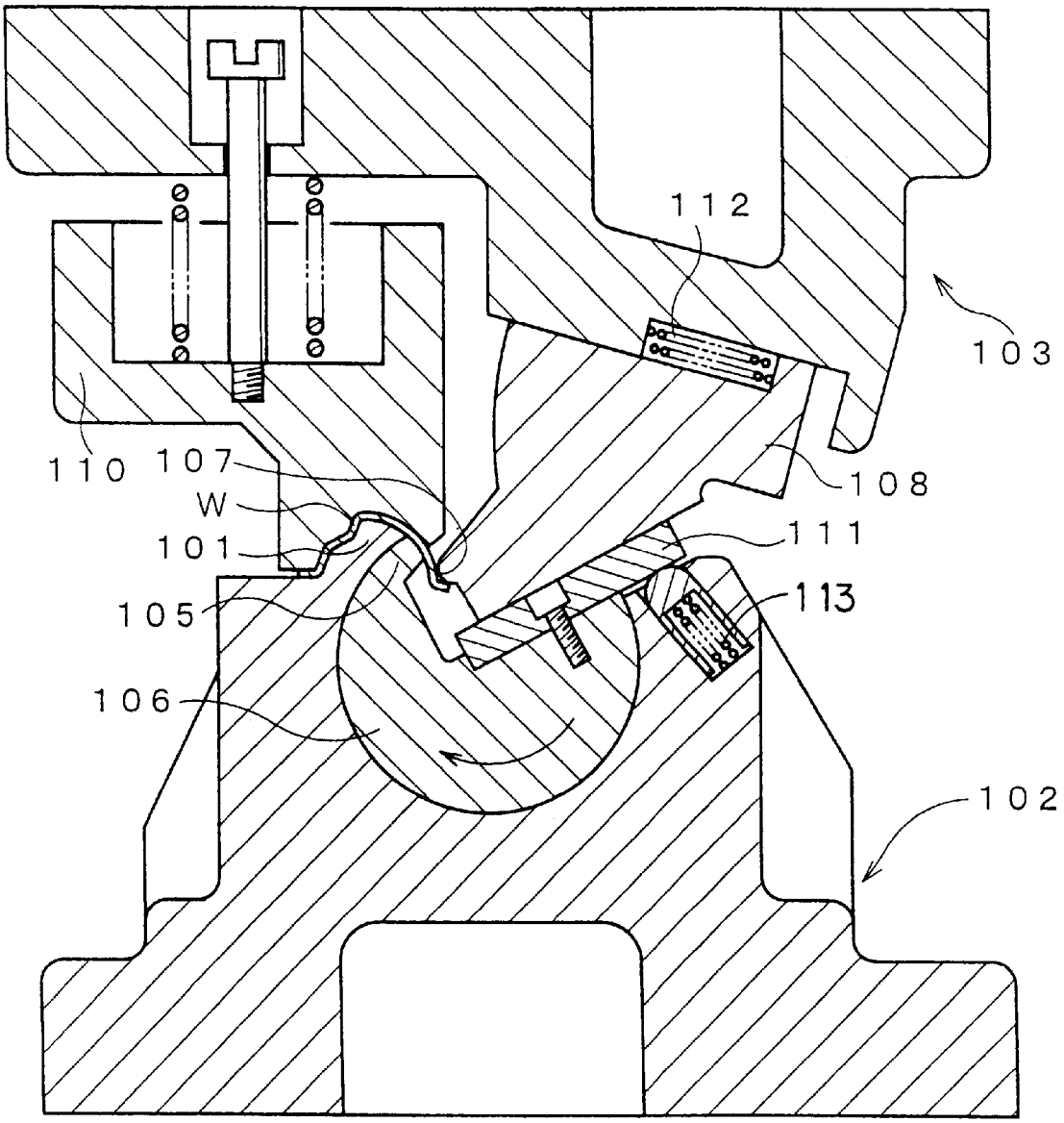
FIG. 6 BACKGROUND ART
FIG. 6 is a sectional side view of the prior art negative-angle forming die in FIG. 5, with the upper die half in its downward stroke, beginning to contact a lower die half thereby making contact with a work.
Figure 7:
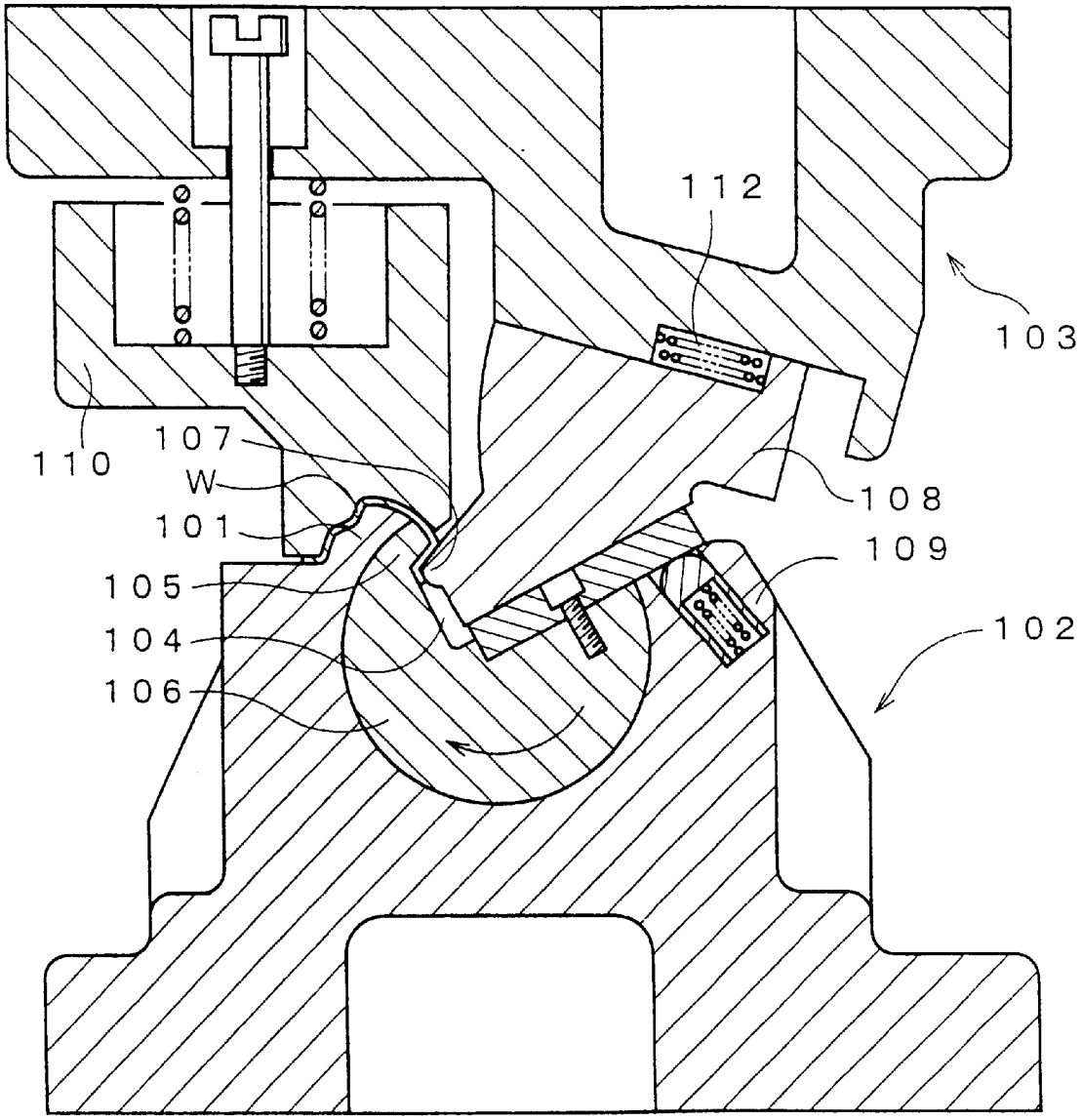
FIG. 7 BACKGROUND ART
FIG. 7 is a sectional side view of the prior art negative-angle forming die in FIG. 5, with the upper die half being at its lower dead center.
Figure 8:
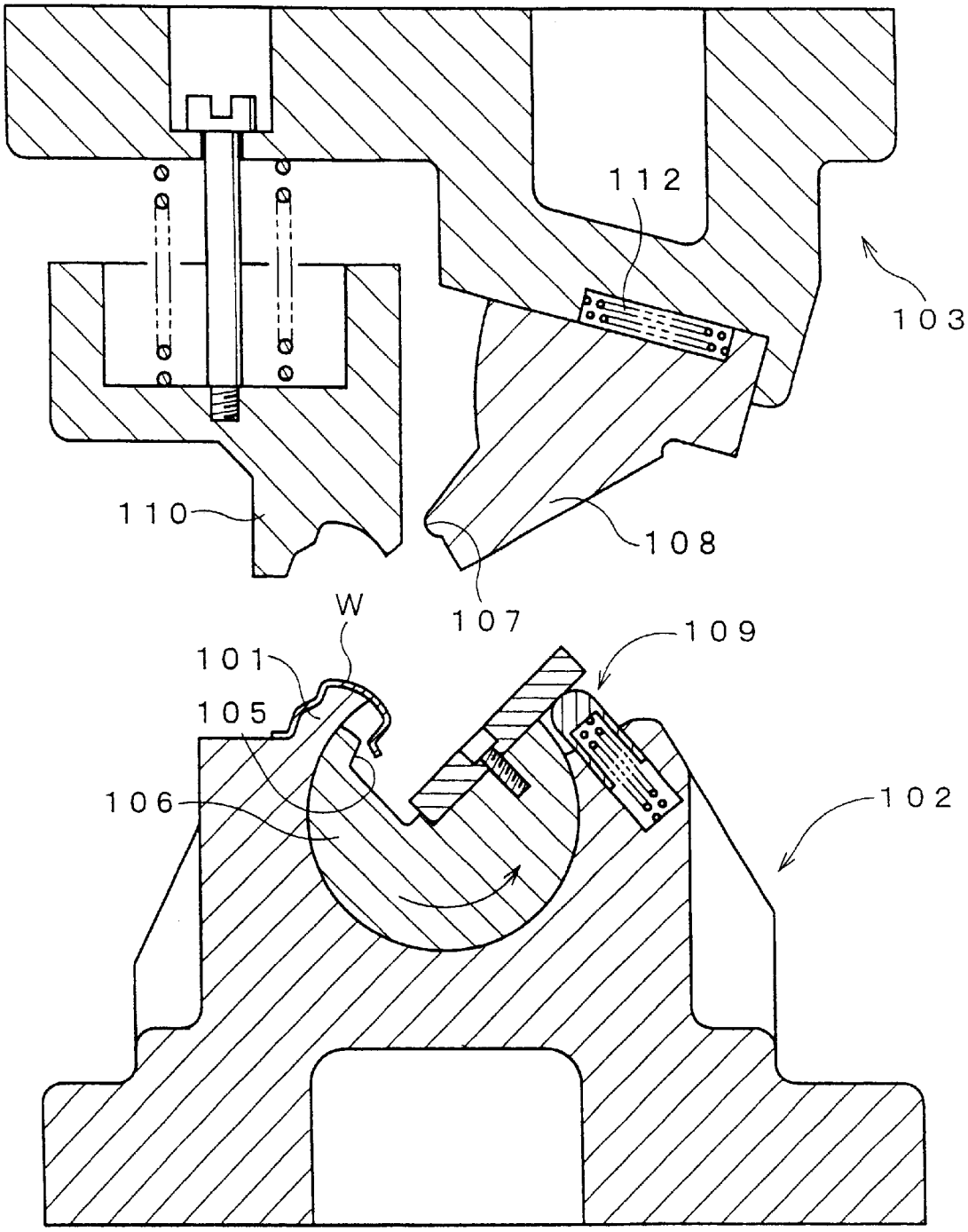
FIG. 8 BACKGROUND ART
FIG. 8 is a sectional side view of the prior art negative-angle forming die in FIG. 5 as after the intrusion forming, with the upper die half lifted to its upper dead center.

FIG. 2 and FIG. 3 show a state in which the upper die half 3 is at its upper dead center and at its lower dead center respectively.

When the upper die half 3 lowers from the upper dead center, the slanted surface 62*a* of the cam surface 62 of the driver 53 makes contact with the cam follower 55 of the cam follower arm 52 of the lower die half 1, causing the rotary cam 5 to begin pivoting. When the cam follower 55 reaches the vertical portion of the cam surface 62, the rotary cam 5 stays in the forming attitude. When the intrusion formation of a work is completed, the upper die half 3 is lifted. Since the cam follower 52 is no longer bound, the rotary cam 5 is automatically retracted by the cylinder 51.

As has been described, according to the present invention, timing adjustment of the rotation of the rotary cam becomes unnecessary.

The present invention provides, as has been described, a rotary cam driving apparatus for a negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion inward of a downward stroke line of the upper die half, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after the forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, a center portion of a cam follower arm being fastened to the supporting shaft, an end of the cam follower arm being connected to a piston rod of a cylinder provided in the lower die half, another end of the cam follower arm being contacted with a driver provided in the upper die half. Therefore, there is no need for the timing adjustment of the air cylinder operation at the time of pressing operation and piping necessary for the air cylinder can be simplified.

What is claimed is:

1. A rotary cam driving apparatus for a negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, a center portion of a cam follower arm being fastened to the supporting shaft, an end of the cam follower arm being connected to a piston rod of a cylinder provided in the lower die half, another end of the cam follower arm being contacted with a driver provided in the upper die half.

2. A negative-angle forming die comprising:

a first die half comprising:
a supporting portion for placing a sheet metal work, and an intrusion forming portion;

a second die half carrying a plate-like cam to be moved toward the second die half for forming the work;

a rotary cam, the ends of which terminate in first and second shafts journaled in the second die half;

a slide cam, including an intrusion forming portion, slidably opposed to the rotary cam;

a cam follower arm centrally fastened to the first supporting shaft; one end of the cam follower arm carrying a cam follower in operable relationship with the plate-like cam carried by the first die half;

wherein moving contact between the plate-like cam and the cam follower causes the cam follower arm to rotate causing rotation of the rotary cam;

wherein the work placed on the supporting portion of the second die half is formed by the intrusion forming portion of the rotary cam and the intrusion forming portion of the slide cam.

3. A negative-angle forming die comprising:

a first die half comprising:
a supporting portion for placing
a sheet metal work, and
an intrusion forming portion;

a second die half carrying a plate-like cam slidably movable in the direction of the second die half;

a rotary cam having an axis of rotation, wherein the ends of the rotary cam terminate in first and second shafts journaled in the second die half;

a slide cam, including an intrusion forming portion, slidably opposed to the rotary cam;

a cam follower arm centrally rigidly fastened to the first supporting shaft; one end of the cam follower arm carrying a cam follower in operable relationship with the plate-like cam carried by the first die half;

wherein moving contact between the plate-like cam and the cam follower causes the cam follower arm to rotate causing rotation of the rotary cam and advancement of the intrusion forming portion of the rotary cam in a direction toward the slide cam;

wherein advancement of the intrusion forming portion of the slide cam toward the intrusion forming portion of the rotary cam forms the work.

* * * * *